US007279050B2

(12) United States Patent
Van Epps, Jr. et al.

(10) Patent No.: US 7,279,050 B2
(45) Date of Patent: Oct. 9, 2007

(54) ONE-PIECE BOTTOM EDGE WIPE SPONGE FOR CLEANING A PHOTORECEPTOR DRUM

(75) Inventors: Jean D. Van Epps, Jr., Palmyra, NY (US); Michael J. Duggan, Webster, NY (US); James R. Lee, Sodus Point, NY (US); Steven D. Bush, Red Creek, NY (US)

(73) Assignee: Xerox Corporation, Stamford, CT (US)

( * ) Notice: Subject to any disclaimer, the term of this patent is extended or adjusted under 35 U.S.C. 154(b) by 631 days.

(21) Appl. No.: 10/620,663

(22) Filed: Jul. 16, 2003

(65) Prior Publication Data

US 2004/0078908 A1 Apr. 29, 2004

Related U.S. Application Data

(60) Provisional application No. 60/422,254, filed on Oct. 29, 2002.

(51) Int. Cl.

| | |
|---|---|
| ***B08B 7/00*** | (2006.01) |
| ***B08B 9/04*** | (2006.01) |
| ***B08B 1/02*** | (2006.01) |
| ***B08B 3/00*** | (2006.01) |

(52) U.S. Cl. ..... 134/6; 134/8; 134/32; 134/34; 134/22.1; 134/25.4; 134/42; 15/304; 15/327.1; 15/97.1; 15/101

(58) Field of Classification Search ..... 134/6, 134/8, 32, 34, 42, 22.1, 25.4; 15/304, 327.1, 15/97.1, 101

See application file for complete search history.

(56) References Cited

U.S. PATENT DOCUMENTS

| | | | | |
|---|---|---|---|---|
| 4,783,108 | A | 11/1988 | Fukuyama et al. | 294/98.1 |
| 5,091,278 | A | 2/1992 | Teuscher et al. | 430/58 |
| 5,120,628 | A | 6/1992 | Mammino et al. | 430/59 |
| 5,167,987 | A | 12/1992 | Yu | 427/171 |
| 5,334,246 | A | 8/1994 | Pietrzykowski, Jr. et al. | 118/69 |
| 6,461,442 | B1 | 10/2002 | Bush et al. | 134/8 |

FOREIGN PATENT DOCUMENTS

| | | | |
|---|---|---|---|
| JP | 11-137499 | * | 5/1999 |
| JP | 2000-267312 | * | 9/2000 |

* cited by examiner

*Primary Examiner*—Mikhail Kornakov
(74) *Attorney, Agent, or Firm*—Oliff & Berridge, PLC

(57) ABSTRACT

A one-piece sponge cleans and removes coating material from the bottom edge, inside and outside surface of a photoreceptor drum. The one-piece sponge has an inner sponge section and an outer sponge section, both with internal channels to remove solvent and dissolved coating material.

11 Claims, 3 Drawing Sheets

ONE-PIECE BOTTOM EDGE WIPE SPONGE FOR CLEANING A PHOTORECEPTOR DRUM

This application is based on a Provisional Patent Application No. 60/422,254, filed Oct. 29, 2002.

BACKGROUND OF THE INVENTION

This invention relates in general to electrophotography and, more specifically, to a system for removing coating material from an end of a drum.

In electrophotography, coated substrates such as cylindrical photoreceptor drums (photoreceptors) are commonly used in copier, duplicator, facsimile and multifunctional machines. Photoreceptor embodiments include at least one coating of photosensitive material comprising a film forming polymer material, which can be formed on the photoreceptor by known techniques such as immersion or dip coating.

The peripheral ends of a coated photoreceptor are often used to engage members such as spacers, rollers, seals, developer housings, grounding devices and the like. If these members ride on a coated area of the drum, the coating material is rubbed off and the resulting debris can contaminate various components in the machine such as the cleaning system and any optical exposure systems employed in the machine. Also, the coating can interfere with devices that are designed to electrically ground the drum by contacting the outer surface at one end of the drum. Moreover, if the coating thickness is irregular because of poor removal techniques, spacing devices riding on the outside surface of the drum cannot maintain precise spacing between the drum and critical subsystems such as charging, developing, cleaning or other subsystems. Further, if coating material is present in the interior of the drums adjacent the ends of the drum, insertion of supporting end caps may be prevented or hindered. Also, uneven coating deposits in the interior of the drums can cause misalignment of the end caps which, in turn, can cause the drum to wobble during image cycling. The uncoated region at the end of the drum is also necessary to prevent delaminating or cracking of the organic layers at the base of the photoreceptor when the photoreceptor is cycled in an imaging machine. Thus, specified areas at both the outer and inner peripheral ends of a photoreceptor must be free of coating material.

The top of the drum may be maintained free of deposited coating by not immersing a small portion of the upper end of the drum into the coating solution. More specifically, the upper end of the photoreceptor drum can be kept free of coating material by orienting the drum vertically and dipping the drum into a bath of coating material to a predetermined depth which avoids complete immersion of the drum. However, the coating formed over the lower end of the photoreceptor must still be removed or prevented from depositing during dip coating.

U.S. Pat. No. 6,461,442 to Bush et al. for a "Process For Removing A Strip of Coating Material", commonly assigned as the present application and herein incorporated by reference, teaches a two-piece cleaning foam to clean the bottom edge of a photoreceptor drum. The two-piece cleaning foam has a first piece of an inner foam and a second piece of an outer foam bonded together. The outer foam has an external drain groove to remove solvent and coating material from the drum. The two-piece foam requires precise alignment during fabrication and bonding of the two pieces. The two-piece foam has problems with formation of bubbles due to solvent flow around and through the two-piece foam.

Bubbles reduce the efficiency of the removal of strip material for the photoreceptor drum.

It is, therefore, an object of the present invention to provide an improved edge cleaning system for electrophotographic imaging drums.

It is another object of the present invention to provide a one-piece sponge to clean the bottom edge of a photoreceptor drum.

It is yet another object of the present invention to provide improved solvent drainage in an edge cleaning system for electrophotographic imaging drums.

BRIEF SUMMARY OF THE INVENTION

A one-piece sponge cleans and removes coating material from the bottom edge, inside and outside surface of a photoreceptor drum. The one-piece sponge has an inner sponge section and an outer sponge section, both with internal channels to remove solvent and dissolved coating material.

DESCRIPTION OF THE DRAWINGS

A more complete understanding of the present invention can be obtained by reference to the accompanying drawings wherein.

Figure 1:
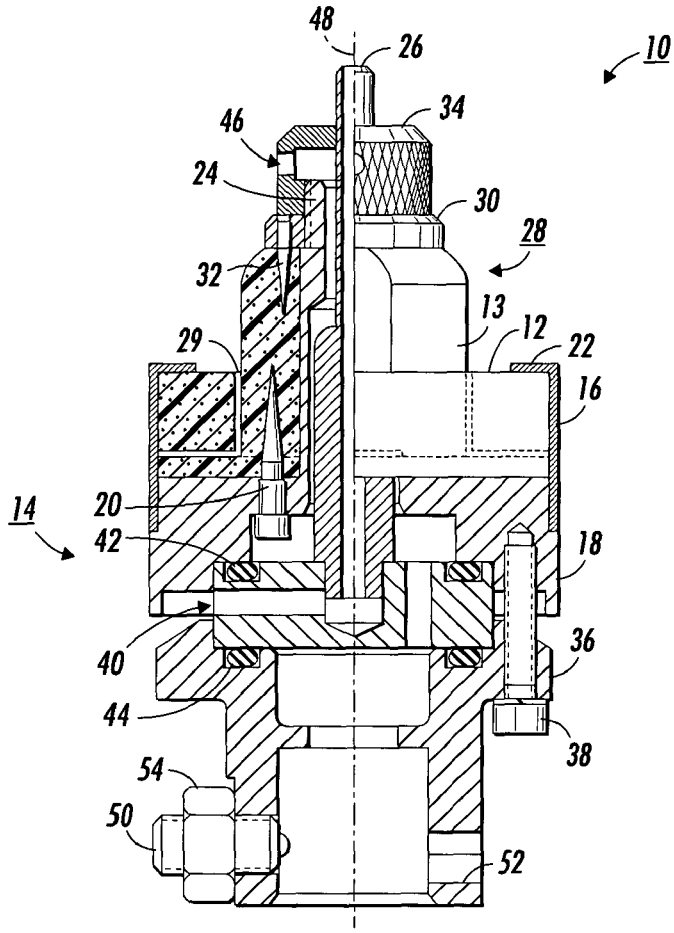
FIG. 1 is a schematic front view in elevation of a cleaning assembly of this invention.

These figures merely schematically illustrate the invention and are not intended to indicate relative size and dimensions of the device or components thereof.

DETAILED DESCRIPTION OF THE DRAWING

For purposes of illustration, the process according to the invention will be described with reference to the treatment of a coated cylindrical photoreceptor.

Figure 2:
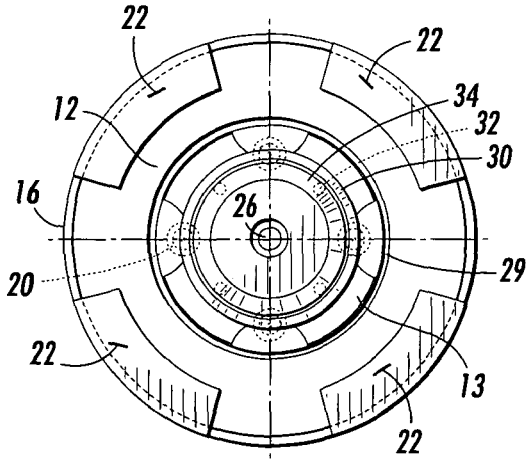
FIG. 2 is a schematic plan view of the cleaning assembly shown in FIG. 1.
Figure 3:
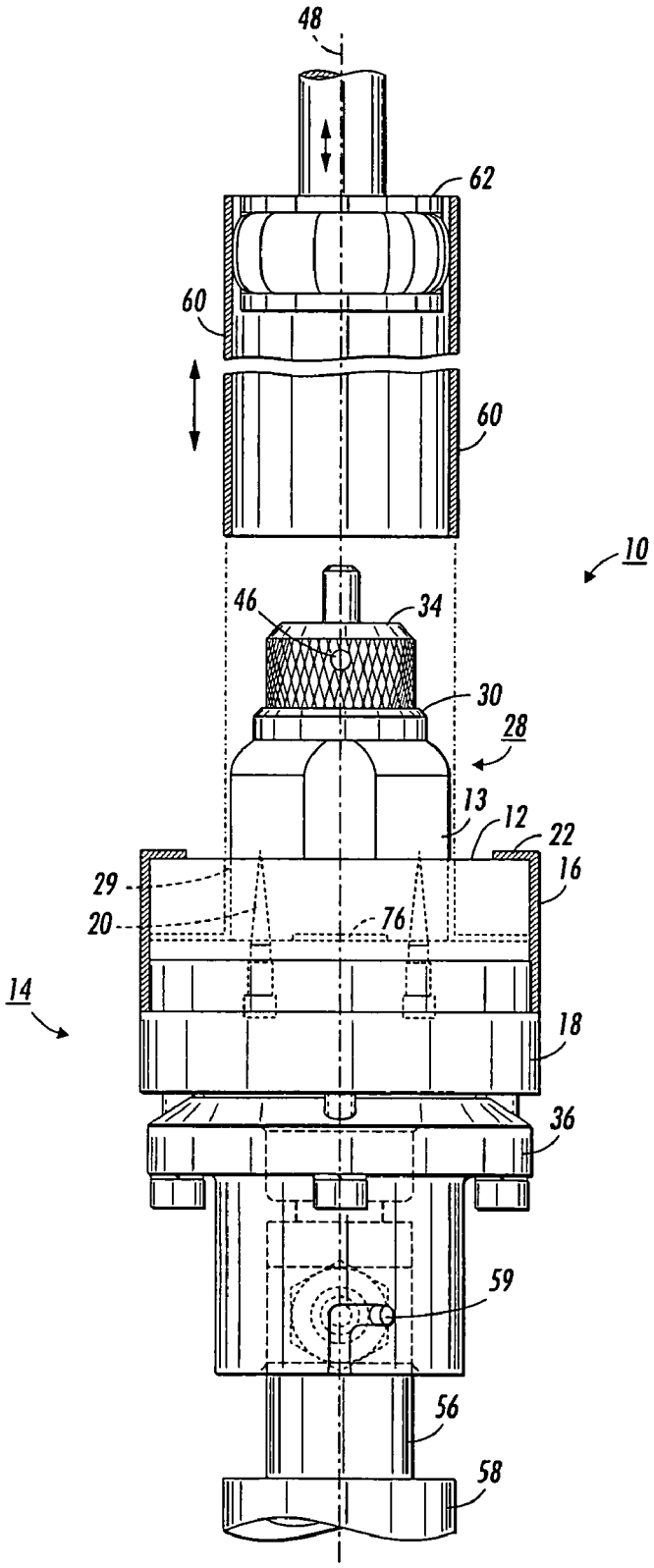
FIG. 3 is a schematic side view in elevation of a cleaning assembly of this invention.

Referring to FIGS. 1, 2 and 3, a cleaning assembly 10 of this invention is shown comprising a one-piece sponge 12 retained in a housing 14 comprising a bowl ring 16 removably mounted on a base 18. Secured to base 18 is at least one threaded spike 20 which penetrates sponge 12 and prevents it from turning during cleaning. An optional bowl lip 22 along the upper periphery of bowl ring 16 ensures retention of sponge 12 during cleaning. Any suitable housing 14 may be utilized to retain the sponge 12 during the coating removal operation. The housing may be solid, foraminous, notched, and the like. The housing should be sufficiently rigid to retain the sponge in position during the cleaning operation. Generally, where a bowl lip 22 is omitted, the sponge 12 is sufficiently compressed when confined within the housing 14 to achieve a friction fit which retains the sponge in the housing during the coating removal cycle. Alternatively, retaining members may be used to prevent slippage. Any suitable retaining member may be utilized. Typical retaining members include, for example, pins, spikes, knurled interior surfaces of the housing (not shown) and the like. Secured to and extending upwardly from base 18 is a hollow shaft 24 having an upper externally threaded end. Coaxially enclosed within and spaced from hollow shaft 24 is a vent tube 26. A resilient guide spindle 28 is positioned around shaft 24 and on top of sponge 12.

Sponge 12 contains a circular slit 29 having a diameter equal to or slightly smaller than the largest diameter of resilient guide spindle 28. Pin washer 30 carries at least one pin 32 which becomes imbedded into resilient guide spindle 28 when threaded screw cap 34 is screwed onto the upper threaded end of hollow shaft 24. Threaded screw cap 34 also presses resilient guide spindle 28 against sponge 12 to ensure retention of sponge 12 within housing 14 during the cleaning operation. Base 18 is securely fastened to shaft flange 36 by a plurality of bolts 38. Spacer ring 40 is sandwiched between base 18 and shaft flange 36 with O-rings 42 and 44 providing solvent tight seals to allow solvent to be fed through hollow connecting passageways extending through shaft flange 36, spacer ring 40, base 18, hollow shaft 24 and screw cap 34. Screw cap 34 contains at least one exit opening 46 to allow solvent to exit screw cap 34 and flow downwardly over guide sponge 13 onto sponge 12. Guide spindle 28 contains at least one groove 48 to enhance flow of solvent to clean sponge 12. Instead of, or in combination with, flow of solvent from exit opening 46, solvent may be fed directly to sponge 12 by holes or ducts (not shown) in hollow shaft 24 or base 18 adjacent to sponge 12. Shaft flange 36 also carries a ball plunger 50 and a quarter turn pin slot 52. Hex nut 54 facilitates adjustment of ball plunger 50.

Also shown in FIG. 3 is a drive shaft 56 driven by a drive device 58. Drive shaft 56 has a pin 59 which aids in connecting shaft 56 to flange 36. Any suitable drive device 58 may be utilized. Typical drive devices include, for example, a gear box, a smart motor, an air driven motor, and the like. When activated, drive device 58 causes cleaning assembly 10 to rotate around an imaginary axis or centerline. A coated drum 60 carried by reciprocatable chuck 62 is advanced downwardly over resilient guide spindle 28 and into circular slit 29 for simultaneous removal of coating material from a circumferential strip on the inside surface and outside surface of the lower end of drum 60. Upon completion of coating removal, reciprocatable chuck 62 is retracted to remove drum 60 from cleaning assembly 10.

Figure 4:
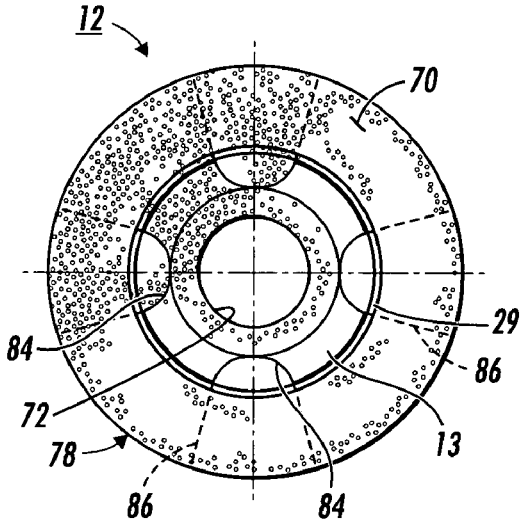
FIG. 4 is a schematic plan view of the one-piece sponge of this invention.
Figure 5:
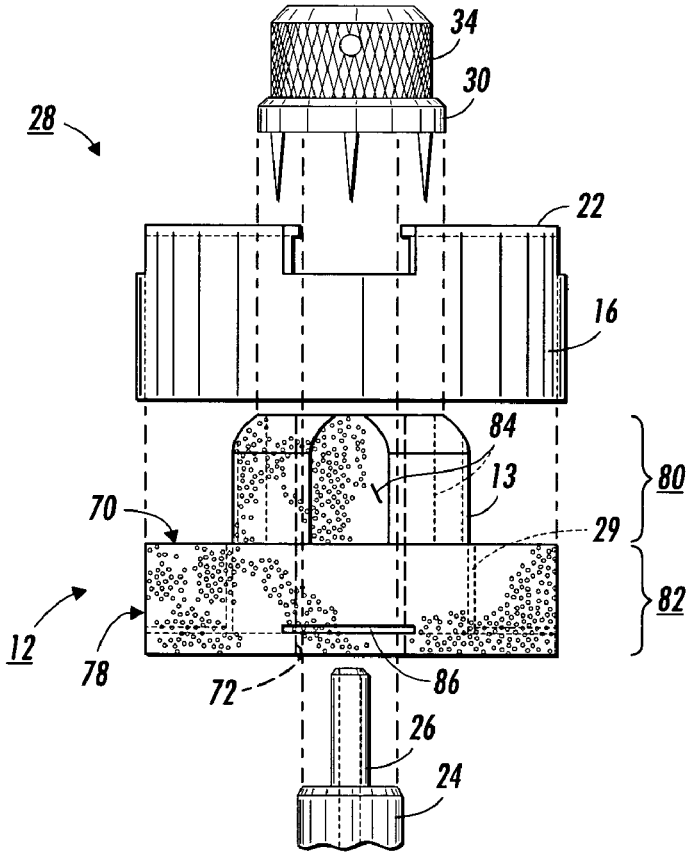
FIG. 5 is a schematic illustration in elevation of the one-piece sponge shown in FIG. 4.

Illustrated in FIGS. 4 and 5 is a sponge 12 of this invention. One-piece sponge 12 contains a circular slit 29 which extends vertically downwardly from the substantially horizontal upper surface 70 of sponge 12 and a guide sponge 13 to extend horizontally up the guide spindle 28. A centered, axially aligned hole 72 allows guide sponge 13 to be slid down on hollow shaft 24 against base 18 (see FIGS. 1 and 3). Circular slit 29 is connected by at least one shallow drain groove 76 which radiates from circular slit 29 to the outer circular wall 78 of sponge 12. Circular wall 78 is perpendicular to the upper surface 70. Shallow drain groove 76 channels solvent and dissolved coating material from circular slit 29 toward the outer periphery of circular wall 78 of sponge 12 during removal of coating material from one end of coated drum 60 (see FIG. 3). The drain grooves 76 or any other suitable channel or channels prevents the formation of puddles which can cause a meniscus leading to wicking of the solvent and dissolved coating material to the outer layer of the photoreceptor which in turn causes an undesirable uneven wipe height.

In operation and referring to FIG. 3, a coated hollow imaging drum 60 having a first lower end, a second upper end, an outside surface, an inside surface and coating material on both the inside surface and the outside surface at the first lower end, is lowered downwardly by reciprocatable chuck 62 by conventional drum transport devices (not shown) over the tapered upper end of guide sponge 13 which aids in centering drum 60. Drum 60 is mounted on chuck 62 such that its longitudinal axis is vertically oriented. Although a preferred vertical orientation of the drum 60 and cleaning assembly 10 is illustrated, any other suitable orientation may be utilized instead. Typical non-vertical orientations include, for example, horizontal and diagonal orientations. Drum 60 is preferably mounted using a conventional chucking device 62 coupled to a drum transport mechanism (not shown). Drum transport mechanisms are well known and described for example, in U.S. Pat. No. 5,334,246, the entire disclosure thereof being incorporated herein by reference. The transport mechanism (not shown) may move coated drum 60 to and from the coating removal station. Any suitable conventional chucking device may be utilized. A typical chuck comprises a shaft and inflatable rubber air bladder disclosed, for example, in U.S. Pat. No. 4,783,108, the entire disclosure thereof being incorporated by reference. Lowering of drum 60 is continued until the lower end of drum 60 slides into circular slit 29 of sponge 12 to a predetermined depth. The predetermined depth ensures that the adjacent vertical walls of slit 29 contact the region of the end of drum 60 from which coating material is to be removed by the sponge 12. Thus, the adjacent vertical walls of slit 29 simultaneously contact the coating material on both the inside surface and the outside surface at the first lower end of the drum with cleaning foam 12. Therefore, to remove a circumferential strip of the coating from the bottom of coated drum 60 as cleaning assembly 10 rotates, drum 60 is lowered toward sponge 12 and the bottom edge of drum 60 is slid into slit 29 to a predetermined depth corresponding to the width of the strip of coating material to be removed. Alternately, drum 60 need not be lowered and, instead, the cleaning assembly 10 may be raised (not shown) to a height where the bottom end of drum 60 slides into slit 29 in sponge 12. Drum 60 may be rotated (not shown) or the sponge 12 may be rotated, or both drum 60 and foam 12 may be rotated (not shown) to achieve relative movement between the sponge and the drum surface during coating removal.

Liquid solvent is pumped from any suitable source by conventional pumps such as gear pumps, centrifugal pumps, and the like (not shown) through passageways in drive shaft 56, the passageways in cleaning assembly 10 and out exit openings 46 and/or through other suitable openings in hollow shaft 24 or flange 36 (not shown) adjacent sponge 12. The solvent flows down the outer surface of guide sponge 13, including along grooves 48, into slit 29, under the lower end of the drum, up out of slit 29 and along drain grooves 76. Preferably a limited amount of the solvent also flows over much of the upper surface 70 of sponge 12 not occupied by the shallow drain groove 76 to remove coating material residue and prevent carry over of this residue to the next drum to be cleaned.

As the solvent flows from the inside surface of drum 60 to the outside surface of the lower end of drum 60, it coats those surfaces of sponge in slit 29 which contact the interior and exterior regions of the end of drum 60 from which coating material is to be removed. It is preferred that the solvent flow to the contacting interface between the inside surface of drum 60 and the adjacent sponge 12, then under the bottom of drum 60 to the contacting interface between the outside surface of drum 60 and the adjacent sponge 12, and then along the exposed upper surface 70 of the sponge 12, including the drain grooves 76, the solvent and dissolved coating material finally overflowing from housing 14 down into any suitable device, such as a catch tray (not shown). The supplying of a fluid flow of solvent to the contacting interfaces between the inside surface of drum 60 and the adjacent sponge 12 and contacting interface between the outside surface of drum 60 and the adjacent sponge 12 during the coating removal treatment prevents debris from building up at the drum end during the coating removal process. Thus, the solvent flows from the contacting interfaces between the inside surface of drum 60 and the adjacent sponge 12 and contacting interface between the outside surface of drum 60 and the adjacent sponge 12 toward the outer periphery of sponge 12. This prevents coating buildup on the sponge, prevents redeposit of the coating material onto the drum and increases the online production time of the cleaning system. The solvent flow rate depends upon a number of variables including drum size, the width of the strip of coating material to be removed, the thickness of the coating material, the specific coating material to be removed, the specific solvent and the like. Preferably, the fluid flow should be sufficient to carry away the highly concentrated solution of coating material dissolved in solvent and prevent redeposit of the coating material back onto the drum surface. Generally, the size and number of drain grooves or internal channels in the sponge along with the amount of solvent being fed to the slit should be chosen to allow the solvent to escape without any splashing occurring during the removal of the drum from the sponge slit after cleaning is completed. As sponge 12 rotates during the cleaning process, a circumferential strip of coating material is removed from the bottom end of drum 60, exposing the underlying insoluble cylindrical photoreceptor substrate. The 10 sponge 12 remains in contact with the predetermined portion of the end of drum 60 until the intended amount of coating has been removed. The duration for wiping varies with the amount of pressure exerted against the drum, the total contact area and the like. When the desired amount of coating has been removed from the outer predetermined surface of drum 60, the drum and sponge 12 are separated. Once the 15 inner and outer predetermined portions of drum 60 have been treated, the coating removal process is stopped and drum 60 may moved on to another processing station or removed from the chucking device for further processing or use.

In the embodiment shown in FIG. 3, the cleaning assembly is rotated about its axis by drive device 58 to achieve relative movement and scrubbing contact between the surfaces of sponge 12 in slit 29 and the adjacent interior and exterior surfaces of drum 60. Alternatively, the cleaning assembly may be stationary and the chuck and drum may be rotated or both the cleaning assembly and the chuck and drum may be rotated in opposite directions to achieve relative motion between the contacting sponge material and the drum surface. This relative movement between the sponge material and the drum simultaneously removes coating material from the inside surface and the outside surface of the lower end of the drum. Generally, it is preferred that the sponge 12 is not vertically reciprocated, but merely rotated with the drum being lowered down into the circular slit 29.

The cleaning assembly 10 is preferably rotated about its longitudinal axis during the removal of the coating. The speed of rotation varies with the diameter of the drum, the width of the circumferential region to be cleaned, the thickness of the coating or coatings, the materials of the coatings, the solvent, the temperature, the sponge material, the contact pressure between the sponge material and drum, and the like. A typical sponge housing rotational speed rpm is about 35 rpm. However, speeds greater than or less than 35 rpm may be utilized so long as the cleaning objectives of this invention are satisfied. Excessive speed reduces wiping quality and the solvent begins to function as lubricant with less shear and friction, thereby reducing the wiping effectiveness because the sponge merely rides (surfs) on top of the solvent without adequately contacting the coating and drum substrate.

The substrate for coated drum 60 may comprise any suitable material. Typical materials include, for example, aluminum, nickel, zinc, chromium, stainless steel, cadmium, titanium, metal oxides, plastics, composites, and the like. The substrate may comprise one layer or a plurality of layers, for example conductive layer coated over an insulating layer. The thickness of the substrate can vary widely depending on the intended use of the photoreceptor, and preferably is from about 65 micrometers to about 5 millimeters thick, most preferably from about 0.05 millimeter to about 2 millimeters thick. However, thicknesses outside these ranges may be utilized where suitable. The substrate is insoluble in the solvents employed for coating removal. There does not appear to be any criticality as to the diameter of the drum, thickness of the drum, length of the drum, or the material of the drum.

The process of this invention removes various types of known photoreceptor coatings which can be dissolved with a solvent. These coating can include one more layers, and typically will include multiple layers such as a blocking layer, a charge generating (photogenerating) layer, a charge transporting layer and an optional overcoat layer. Thus, preferably, all of the solvent soluble coating layers present at the outer and inner peripheral end region of the photoreceptor are removed.

The coating removed preferably includes, as a photoconductive material, one or a plurality of layers of organic resins carrying dispersed photoconductive materials. Such coatings include, for example, a photoconductive material such as pigments dibromoanthanthrone, metal-free and metal phthalocyanines, halogenated metal phthalocyanines, perylenes, azo pigments, and the like carried in a suitable organic binder resin. Examples of typical organic binder resins include polycarbonates, acrylate polymers, vinyl polymers, cellulose polymers, polysiloxanes, polyamides, polyurethanes, polyesters, block, random or alternating copolymers thereof, and the like.

The layer or layers of coatings on the drums are formed using well-known techniques and materials. For example, the coatings may be applied to the drum substrate by immersion, spray coating, dip coating, or the like. Dip coating or spray coating is preferred. Typical coating techniques and materials are illustrated in U.S. Pat. No. 5,091,278, U.S. Pat. No. 5,167,987 and U.S. Pat. No. 5,120,628, the entire disclosures thereof being incorporated herein by reference. The process of this invention can be carried out in conjunction with a coating process, preferably after the coating has partially hardened. Although removal of a partially dried coating is preferred, removal of dried coatings may also be accomplished with the process of this invention.

Any suitable solvent may be employed with the foam 12 to remove the coating material from the bottom of drum 60. Typical solvents include, for example, methylene dichloride, tetrahydrofuran, toluene, n-butyl acetate, n-butyl alcohol, xylene, and the like.

Any suitable resilient solvent resistant sponge material may be utilized for sponge 12. Preferably, the sponge material comprises cellular synthetic solvent resistant polymer material generally resembling natural sponge. Typical solvent resistant sponge materials include, for example, polyethylene, polypropylene, neoprene, and the like, which do not dissolve or swell in the solvent employed for coating removal. Selection of the solvent resistant sponge depends upon the specific cleaning solvent utilized. Thus, for example, neoprene is solvent resistant to xylene, n-butyl alcohol an n-butyl acetate, but is not resistant to tetrahydrofuran.

The sponge pores may be closed cell or open cell. Most of the cells along the outer surface and in the walls of circular slit 29 of the sponge 12 are open cells for more uniform removal of solvent and dissolved coating material and migration of removed dissolved coating material. These open cells are present even with closed cell foam because the cutting operation to fabricate and shape the foam, cuts open the closed cells along the surfaces cut. Generally, an average cell diameter of between about 1 millimeter and about 3 millimeters is preferred. Also preferred is a cell size having an average diameter less than about the width of the area at the bottom of the drum which is to be cleaned. However, cell sizes outside these ranges may be employed so long as the cleaning objectives of this invention are satisfied. The cell walls of the sponge should be sufficiently stiff to provide a scrubbing action which, with the aid of liquid solvent removes the coating material from the bottom of the drum. A less than 6 lb. sponge material of closed cell polyethylene provides optimum results. However, sponge material greater than or less than about less than 6 lb. may be employed so long as the cleaning objectives of this invention are satisfied. The sponge material should be solvent insoluble and sufficiently resilient to rapidly return to its original shape after being deformed by pressure.

The circular slit 29 is concentric with the imaginary rotational axis of cleaning assembly 10. The diameter of the circular slit, when the sponge is in the free uncompressed state, is preferably about same as the outside diameter of the drum being treated. Some sponges exhibit a limited amount of expansion which can be controlled by the bowl ring. Generally, at least some compression of the sponge is desirable to exert sufficient pressure against the interior and exterior surfaces of the drum during cleaning.

When the sponge in the housing is viewed with the naked eye from above (plan view) prior to insertion of the drum into the slit, the slit is substantially invisible or barely discernable because the opposing sides of the slit are in contact with each other. Generally, the slit in the sponge for receiving the end of the drum is preferably cut substantially vertically into the sponge. However, limited deviation from vertical may be tolerated, particularly where the width of the area to be cleaned is narrow. Thus, preferably, the opposing walls on each side of the slit are vertical and substantially parallel with the outer and inner contacting surfaces of the drum. The depth of the slit does not appear to be critical, and may extend all the way to the bottom of the sponge. Also, depending on the width of the strip to be cleaned of coating material, the degree (distance) of drum insertion into the slit may vary for different production runs of different photoreceptors. Thus, the amount of interference contact due to entry of the drum into the sponge slit can vary for different production runs, even though the same sponge is used for coating removal. Typical widths of cleaned bottom edges of drums extend from about 0.5 millimeter to about 15 millimeters. Preferably, the sponge is utilized to remove a coating in a strip having a width between about 3.5 millimeters and about 9 millimeters. Generally, if the strip of coating material on the drum is too wide, too much coating material must be carried away by the solvent and solvent flow, and complete cleaning may be difficult to achieve.

As shown in FIGS. 4 and 5, the sponge 12 has an inner sponge section 80 and an outer sponge section 82. The inner sponge section 80 extends inward from the circular slit 29 to the guide spindle 28 and as the guide sponge 13 up the spindle towards the pin washer 30. The outer sponge section 82 extends outward from the circular slit 29 to the bowl ring 16.

Internal channels 84 run from the guide sponge 13 through the inner sponge section 80 to the circular slit 29. The internal channels for the inner sponge section drain away excess solvent and dissolved coating material through the sponge and reduce the occurrence of bubbles in the area of the sponge. The internal channels of the inner sponge section help prevent any build up of solvent within the interior of the drum during cleaning and avoid the solvent rushing out of the interior of the drum and splashing up onto the unwiped area of the drum which may cause a defect when the drum is removed from the slit.

Bubbles reduce the efficiency of the solvent cleaning the bottom edge of the photoreceptor drum. The percent defective yield loss associated with bubbles in the area of the sponge is decreased threefold by internal channels in the inner sponge section.

The outer sponge section 82 also has internal channels 86 extending from the circular slit 29 to the outer circular wall 78 to drain away excess solvent and dissolved coating material.

The one-piece sponge 12 provides precise alignment of the inner sponge section 80 with the outer sponge section 82 and the circular slit 29. This alignment minimizes foreign material and bubbles in the area of the sponge. The internal channels may be formed by any suitable technique such as drilling, hot wire, cutting, stamping, molding and the like.

Preferably, the top of the foam is flat for more precise cleaning within the predetermined boundaries of the region to be cleaned. The outer sides extending from the top to the bottom of the foam may be of any suitable shape such as vertical or inclined. The outer plan view shape of the foam may be of any suitable configuration. Typical configurations include circular, square, octagonal, oval, and the like. However, a circular shape, when viewed in elevation, is preferred for simplicity in installation and minimization of space occupied.

Generally, the foam is slightly larger than the housing in which it is confined. Thus, it is slightly compressed after installation in the housing and is retained therein by a friction fit. This friction fit also ensures that the walls of the slit in the foam exert sufficient pressure against the adjacent surfaces of the drum during removal of a strip of coating material from an end of the coated drum. Therefore, the foam in the housing should exert sufficient pressure to remove the desired amount of the particular coating to be treated. The overall dimensions of the foam change very little due to the slight compression imposed when installed in a housing. The height of the foam does not appear to change after installation in the housing.

The flow rate of the solvent carrying dissolved coating material away from the end of the drum can be increased by any suitable technique including, for example, increasing the number and size of external and/or internal drain channels. Increasing the rpm of the cleaning assembly can also increase solvent removal flow, but an increase in rpm tends to decrease the quality of coating removal as described above.

The process of this invention provide an improved edge cleaning system for electrophotographic imaging drums that reliably removes circumferential strips of coating material having a narrow width as well as those having a wide width. The edge cleaning system of this invention is also easier to maintain, reduces maintenance and is less complex. Further, the edge cleaning system of this invention avoids damage to cleanings system components during cleaning cycles. Also, the edge cleaning system of this invention simultaneously wipes both the inside and outside of the bottom edge of a coated photoreceptor. Moreover, the process of this invention greatly facilitates set up of the cleaning system and eases replacement of a cleaning head in the cleaning foam equipped systems.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A process comprising:

providing a hollow imaging drum having a first end, a second end, an outside surface, an inside surface, and coating material on both the inside surface and the outside surface at at least the first end;

providing a one-piece resilient sponge material having sponge cells, a base section for contacting the outside surface at the first end of the drum, and a guide section for contacting the inside surface at the first end of the drum, wherein the guide section extends from the base section and wherein the guide and base sections each contains one or more channels for flowing liquid solvent for the coating material away from the drum;

simultaneously contacting the coating material on both the inside surface and the outside surface at the first end of the drum with the sponge material;

flowing the solvent to the sponge material where the sponge material contacts the first end of the drum, the sponge material being insoluble in the solvent;

producing relative movement between the sponge material and the drum to simultaneously wipe both the inside surface and the outside surface of the first end of the drum with the sponge material and the solvent and simultaneously remove coating material from the inside surface and the outside surface of the first end of the drum; and flowing the solvent away from the drum, through the channels in the guide section and the base section, to carry away coating material removed from the inside surface and the outside surface of the first end of the drum.

2. A process according to claim 1, wherein the sponge material comprises a sponge having a substantially horizontal upper surface and a vertical circular slit in the upper surface separating the guide section from the base section to receive the first end of the drum for simultaneous wiping of both the inside surface and the outside surface of the first end of the drum with the sponge material.

3. A process according to claim 1 wherein the sponge material comprises a sponge having a substantially horizontal upper surface.

4. A process according to claim 3 wherein the sponge material has a disk shape with a circular wall which is perpendicular to the substantially horizontal upper surface and coaxial with the vertical circular slit.

5. A process according to claim 4 wherein the substantially horizontal upper surface has at least one drain groove extending radially from the slit to the circular wall to channel flowing solvent and coating material away from the drum.

6. A process according to claim 4 including rotating the sponge material while maintaining the drum stationary to produce relative movement between the sponge material and the drum.

7. A process according to claim 1 wherein the sponge material comprises closed cell sponge.

8. A process according to claim 1 wherein the sponge material comprises polyethylene.

9. A process according to claim 1 wherein the sponge material comprise cells having an average cell diameter of between about 1 millimeter and about 3 millimeters.

10. A process according to claim 1 including removing a strip of coating material from the outside surface of the first end of the drum, the strip having a width between about 3.5 millimeters and about 9 millimeters.

11. A process according to claim 1 wherein the sponge material is compressed against the drum while simultaneously wiping both the inside surface and the outside surface of the first end of the drum.

* * * * *